US006534916B1

(12) United States Patent
Ito et al.

(10) Patent No.: US 6,534,916 B1
(45) Date of Patent: Mar. 18, 2003

(54) PANEL DISPLAY WITH A FLUORESCENT LAYER

(75) Inventors: Atsushi Ito, Tokyo (JP); Hironobu Arimoto, Tokyo (JP); Kazuhisa Hemmi, Tokyo (JP)

(73) Assignee: Mitsubishi Denki Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/262,089

(22) Filed: Mar. 4, 1999

(30) Foreign Application Priority Data

Sep. 30, 1998 (JP) ..... 10-277870

(51) Int. Cl.[7] ..... H01J 17/49; H01J 61/02

(52) U.S. Cl. ..... 313/587; 313/582; 313/483; 313/485

(58) Field of Search ..... 313/495, 496, 313/497, 422, 461, 609, 610, 582, 583, 584, 585, 586, 587, 483, 485

(56) References Cited

U.S. PATENT DOCUMENTS

| | | | | |
|---|---|---|---|---|
| 3,755,027 A | | 8/1973 | Gilsing | |
| 3,848,248 A | | 11/1974 | MacIntyre, Jr. | |
| 5,269,997 A | * | 12/1993 | Nakahashi et al. | 364/1.9 |
| 5,383,295 A | | 1/1995 | Strattman | |
| 5,637,958 A | * | 6/1997 | Levine | 313/496 |
| 6,232,716 B1 | * | 5/2001 | Ok et al. | 313/582 |
| 6,239,551 B1 | * | 5/2001 | Park | 313/582 |

FOREIGN PATENT DOCUMENTS

| | | |
|---|---|---|
| EP | 0945886 A1 | 9/1999 |
| JP | 5041165 | 2/1993 |
| JP | 65207 | 1/1994 |
| JP | 6310050 | 4/1994 |
| JP | 6131988 | 5/1994 |
| JP | 945269 | 2/1997 |
| KR | 10-1998-048662 | 9/1998 |
| KR | 10-1998-048663 | 9/1998 |
| WO | WO98/27571 A1 | 6/1998 |
| WO | 9844531 | 10/1998 |

* cited by examiner

*Primary Examiner*—Vip Patel
*Assistant Examiner*—Joseph Williams
(74) *Attorney, Agent, or Firm*—Rothwell, Figg, Ernst & Manbeck

(57) ABSTRACT

Electric discharge is caused in a concave portion (12) to generate ultraviolet light. The ultraviolet light is incident upon a fluorescent layer (14), which emits visible light. The emitted visible light is transmitted through transparent electrodes (24*a*, 24*b*) and radiated from a surface. Because spherical materials (16) are arranged on the inner surface of the concave portion (12), the surface area of the fluorescent layer (14) is enlarged, more ultraviolet light enters the fluorescent layer (14), and the conversion efficiency from ultraviolet to visible light is enhanced.

5 Claims, 3 Drawing Sheets

PANEL DISPLAY WITH A FLUORESCENT LAYER

BACKGROUND OF THE INVENTION

1. Field of the Invention

The present invention relates to a panel display which has a fluorescent layer emitting light by electromagnetic radiation generated through electric discharge.

2. Description of the Related Art

A plasma display has been heretofore known in which electromagnetic (ultraviolet) radiation generated by electric discharge are radiated to a fluorescent layer to thereby emit light, and become common in thin displays. In the plasma display, a panel display is partitioned into a multiplicity of chambers, and the electric discharge of each chamber is controlled. Therefore, each chamber functions as a display pixel, and images are displayed on the entire screen.

Electromagnetic radiation generated by electric discharge is usually ultraviolet, and visible light is emitted by radiating the ultraviolet radiation to a fluorescent material. In general, the electric discharge is caused by arranging electrodes on the surface of the chamber, and ultraviolet ray is irradiated to the fluorescent layer formed on the back surface, and generated visible rays of a color corresponding to the fluorescent material toward the surface.

Here, in the panel display, there is a demand for increasing luminance. In order to increase luminance, raising the conversion efficiency from generated electromagnetic radiation to visible light is preferable raised to merely raising the discharged power.

Additionally, Japanese Patent Laid-Open Publication Nos. Hei 6-310050, Hei 9-45269, Hei 6-131988 and others disclose the mixing of particles into a fluorescent layer, but the fluorescent layer is of a transmission type, and a surface is not made convex/concave. Moreover, Japanese Patent Laid-Open Publication No. Hei 6-5207 discloses a plasma display in which a fluorescent layer is curved, but the surface is not made convex/concave.

SUMMARY OF THE INVENTION

An object of the present invention is to provide a panel display in which the conversion efficiency into visible light is enhanced.

In the panel display of the present invention, a fluorescent layer which emits light by electromagnetic radiation generated through electric discharge is formed on a convex/concave surface.

It may also preferable that the fluorescent layer be formed on the back surface of a panel display electric discharge section and that the lights emitted by the fluorescent layer are irradiated toward the surface.

It may further preferable that a surface under the fluorescent layer be made convex/concave by arranging bulk materials on a flat plane.

Because the present invention is constructed as described above, the following effects are provided:

(1) As a fluorescent layer emitting light as a result of electromagnetic radiation generated by electric discharge is formed on the convex/concave surface, the surface area of the fluorescent layer is enlarged and the absorption probability of ultraviolet rays to the fluorescent layer is increased. Therefore, the conversion efficiency to the visible rays from the electromagnetic waves generated by the electric discharge is raised, the amount of emitted lights is increased, and the luminance can be raised.

(2) When a fluorescent layer is formed on the rear surface of a panel display electric discharge section, and the light emitted from the fluorescent layer are irradiated toward the surface, the amount of light emitted toward the front of the panel display can be increased. In a transmission-type fluorescent layer, the convex/concave surface cannot contribute to the increase of the luminance.

(3) Because the surface under the fluorescent layer is formed convex/concave by arranging bulk materials on the flat plane, no special process other than the arrangement of the bulk materials is necessary.

DETAILED DESCRIPTION OF THE PREFERRED EMBODIMENTS

Embodiments of the present invention will be described hereinafter with reference to the attached drawings.

First Embodiment

Figure 1:
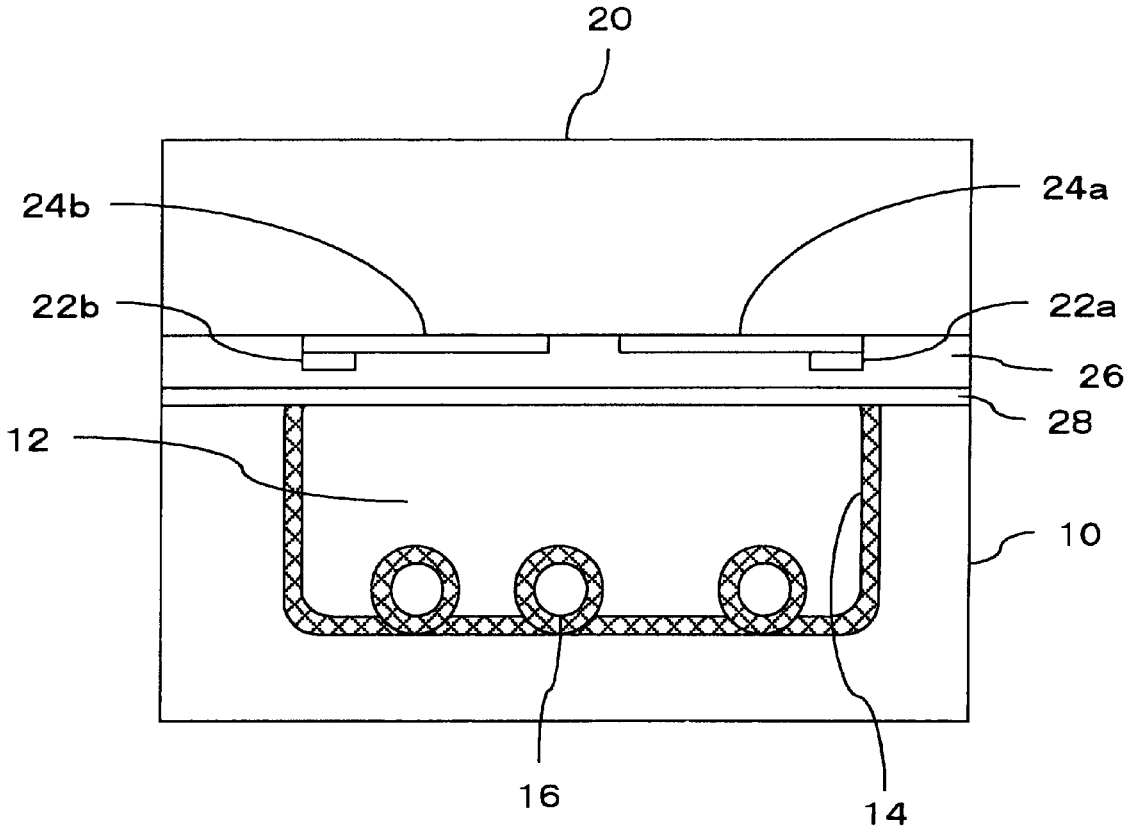
FIG. 1 is a diagram showing the structure of a first embodiment of the present invention.

FIG. 1 shows one display cell (one color) in a panel display according to a first embodiment of the present invention. A back glass substrate 10 is provided on the back surface of the panel display. A fluorescent layer 14 is formed on the inner surface of a concave portion 12 formed in the back glass substrate 10. A pair of bus electrodes 22*a*, 22*b* are arranged on the back surface of a front glass substrate 20 (facing the back glass substrate 10), and connected to transparent electrodes 24*a*, 24*b*, respectively. Here, one of the transparent electrodes 24*a*, 24*b* is a common electrode operated in common with each display cell, while the other electrode is an individual electrode individually operated in each display cell. In order to cover these components, a dielectric layer 26 is formed, as is a protective film 28. Therefore, the protective film 28 usually formed of MgO faces the concave portion 12. Electric discharge is caused in a portion close to the protective film in the concave portion 12, and the portion forms an electric discharge section.

In the first embodiment, bulk materials or spherical materials (e.g. glass beads) 16 are spotted on the inner surface of the concave portion 12 to form a convex/concave surface. The surfaces of the spherical materials 16 are also covered with the fluorescent layer 14. Therefore, the fluorescent layer 14 is formed on the convex/concave surface.

In such a display cell, electric discharge is caused in the concave portion 12 close to the protective layer 28 via the bus electrodes 22*a*, 22*b*, the dielectric layer 26, and the protective layer 28 by applying a predetermined voltage between the transparent electrodes 24*a*, 24*b*. Thereby, gas atoms (e.g., Xe) existing in the concave portion 12 are excited to generate ion/radical atoms (excited atoms). Subsequently, when the ion/radical atoms fall from an excited state to the normal state, ultraviolet radiation (143 nm or 172 nm in the case of Xe gas) is generated. The generated ultraviolet light is incident upon and absorbed by the fluorescent layer 14, and visible light is irradiated from the fluorescent material. Because the visible light is transmitted through the bus electrodes 22*a*, 22*b*, the display is visible to a person in front of the front glass substrate 20.

Additionally, there are three types of fluorescent layers 14, i.e., Red, Green, and Blue (RGB), and three display cells having these fluorescent layers 14 are arranged in parallel to form one display unit. A multiplicity of display units are arranged in a matrix to form the panel display. Full color display is then performed by independently controlling each display cell. In the present example, the size of one display cell is 3 mm×9 mm, and the size of one display unit is therefore about 9 mm×9 mm. However, size is not limited and, for example, units of about half of that size may be employed.

The existence of the spherical materials 16 increases the surface area of the fluorescent layer 14 as compared with a flat layer. This increases the probability that the ultraviolet radiation generated by the electric discharge will be absorbed by the fluorescent layer 14, which in turn increases the amount of emitted light. Especially, in the panel display of the first embodiment, visible light reflected by the fluorescent layer 14 is irradiated toward the front. Therefore, the total amount of emitted light can be increased by placing the spherical materials 16 on the inner surface of the concave portion 12 to enlarge the surface area. However, such a structure decreases the luminance in a fluorescent lamp or other transmission-type fluorescent layer.

In the first embodiment, the concave portion 12 may preferably have a size of 3 mm×9 mm and a depth of about 600 $\mu$m, while the fluorescent layer 14 may have a thickness of about 30 $\mu$m, and the spherical material 16 a diameter of about 50 to 150 $\mu$m.

In a conventional plasma display, one display cell has a size of about several 100 $\mu$m square. Therefore, if the spherical materials 16 are arranged as in the first embodiment, most of the space is occupied by the spherical materials 16, and significant enlargement of the surface area of the fluorescent layer 14 by the arrangement of the spherical materials 16 cannot be expected.

In the present invention, since the size of the display cell is enlarged, the surface area can be enlarged by arranging the spherical materials 16, and the luminance can be raised accordingly. Additionally, if the fluorescent material is improved to reduce the thickness of the fluorescent layer 14, even in the plasma display having a small display cell size, the conversion efficiency from ultraviolet into visible light can be increased by arranging the spherical materials 16 in the concave portion 12 to form a convex/concave inner surface.

For the fluorescent layer 14, after the concave portion 12 is formed in the back glass substrate 10 by sandblasting or other method, a liquid fluorescent agent is supplied to the concave portion 12. Here, the spherical materials are supplied to the concave portion 12 together with the liquid fluorescent agent formed by mixing the fluorescent material in a volatile solvent. The solvent is volatilized by baking the materials, and the fluorescent layer 14 is formed on the convex/concave surface formed by attaching the spherical materials 16 to the inner surface of the concave portion 12 together with the fluorescent layer 14.

The spherical material 16 may be formed of a glass or a metal. Furthermore, the fluorescent material may be compacted to obtain 50 $\mu$m or larger particles. For example, when an adhesive or the like is used, the fluorescent material is formed into particles, and the particles may be mixed into the liquid fluorescent agent. Additionally, the fluorescent layer 14 may be applied, sintered, and formed of fluorescent particles each having a diameter of several $\mu$m. Bulk materials each having an optional shape may be used instead of the spherical materials 16. As described above, since the spherical materials 16 may just be supplied together with the fluorescent agent, any special process is not necessary to make the inner surface of the concave portion 12 convex/concave.

Second Embodiment

Figure 2A:
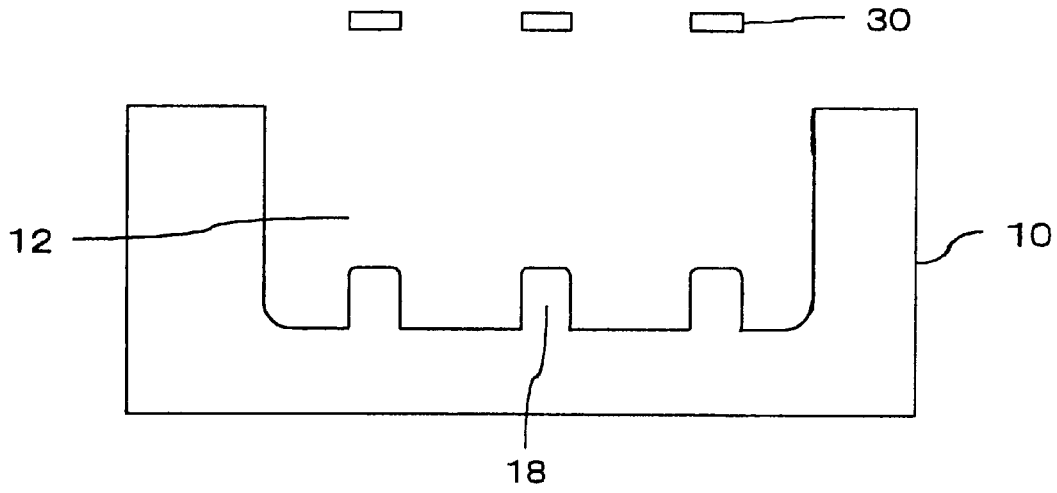
FIGS. 2A and 2B are diagrams showing the structure of a second embodiment of the present invention.
Figure 2B:
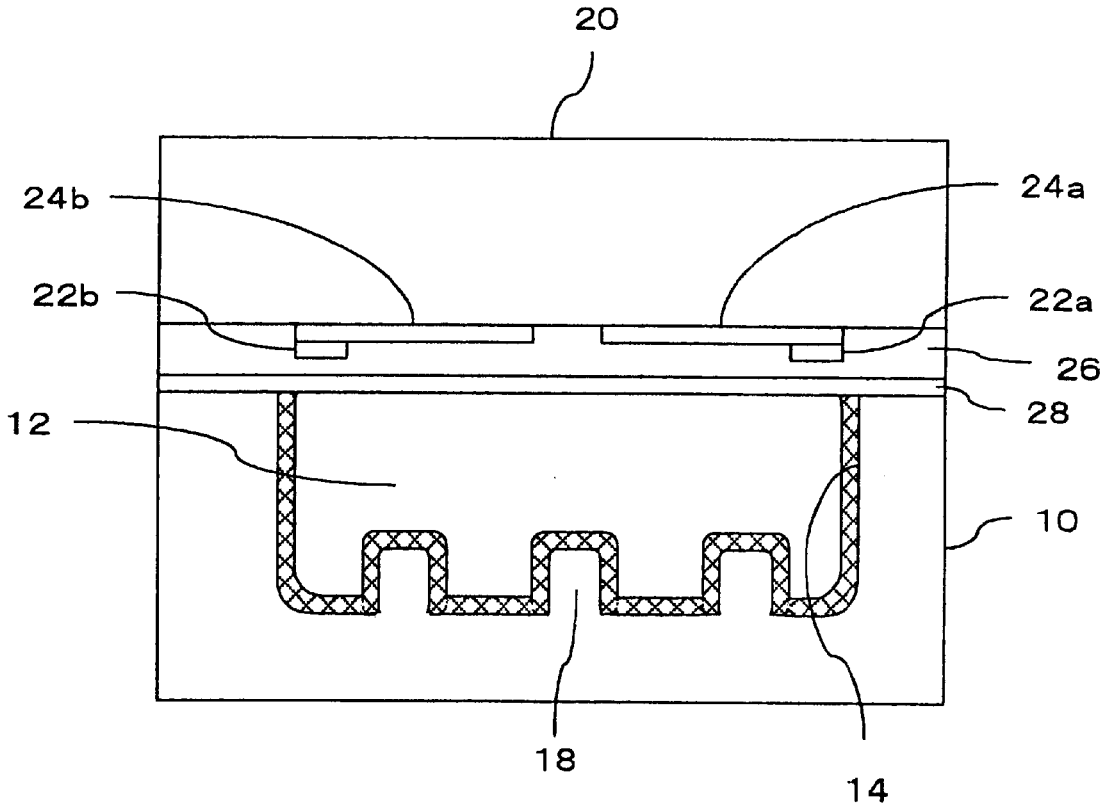

FIGS. 2A and 2B illustrate the configuration produced according to a second embodiment of the present invention. In the second embodiment, a plurality of convex portions 18 are formed on the inner surface of the concave portion 12. The convex portion 18 has a height of about 50 to 150 $\mu$m. The fluorescent layer 14 is formed on the convex portions 18, and the surface area of the fluorescent layer 14 is enlarged in the same manner as in the first embodiment.

Figure 3A:
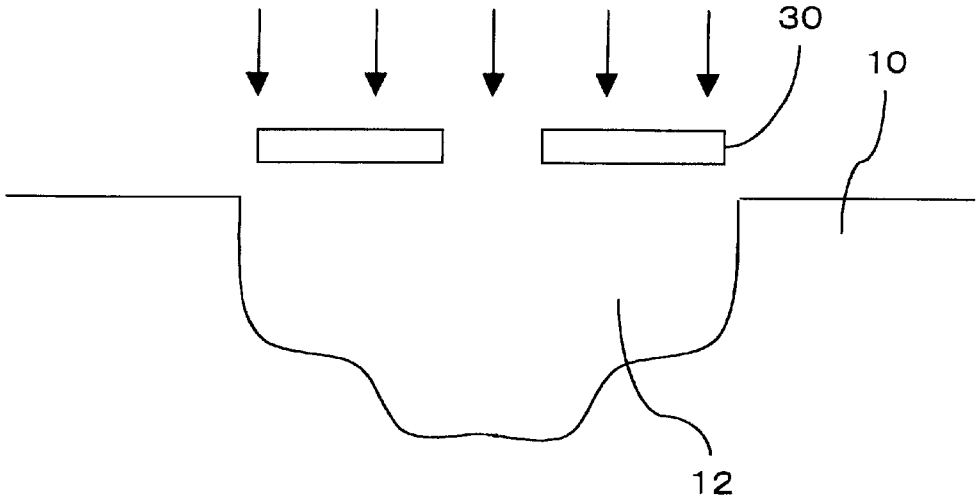
FIGS. 3A and 3B are diagrams showing a modification of the second embodiment.
Figure 3B:
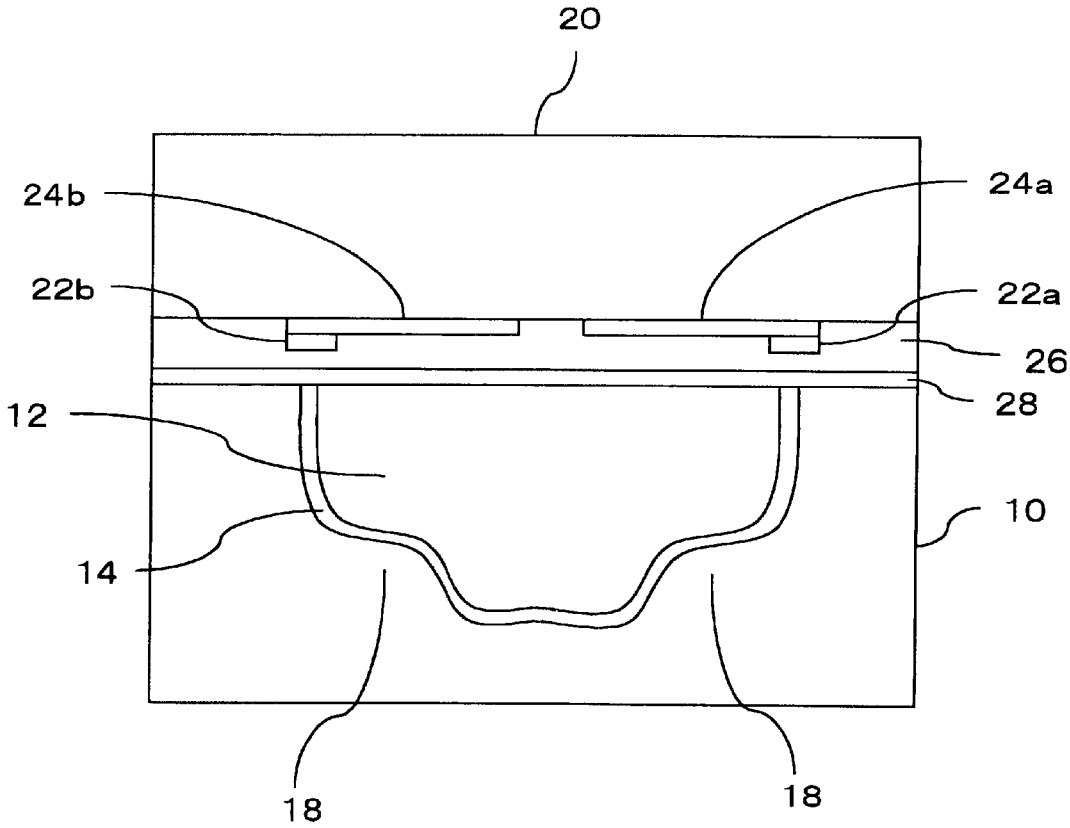

Such convex protrusions 18 can be formed by various means. In the panel display of the first or second embodiment, sand-like particles may be blasted onto the back glass substrate 10 to form the concave portion 12. When some of the sand is deflected with a mask 30, the degree of glass etching is reduced in the corresponding portion, and the convex portions 18 can be formed. In order to form a concave portion 12 having a depth of about 600 $\mu$m, the sandblasting process is usually repeatedly performed. Therefore, a wavy convex/concave inner surface can be obtained by using the mask 30 several times throughout the complete process. Moreover, as shown in FIGS. 3A and 3B, the concave portion 12 may be stepped using the masks 30 for blocking some of the sand. In this case, the surface area can also be made larger as compared with the flat inner surface.

Moreover, the fluorescent layer 14 can entirely be uniformly applied or formed, even on the convex/concave surface, by using a fluorescent agent with higher viscosity than that of a usual fluorescent agent. Furthermore, when the concave portion 12 is formed by sandblasting, the inner surface of the concave portion 12 is made coarse. Therefore, the fluorescent agent will not readily flow and can be easily applied to the surface.

Additionally, the display cell of the present invention is suitable for a flat panel display disclosed in PCT International Application No. PCT/JP98/01444.

What is claimed is:

1. A fluorescent plasma display panel, comprising:

a front transparent substrate having a first surface through which visible light is emitted for viewing by an observer, and a second surface opposite said first surface, containing a plurality of electrodes;

a back substrate attached to said front transparent substrate and having a concave portion defined by an inner surface therein, said concave portion defining a gas discharge space having gas particles therein which are excited by a voltage applied to said electrodes, and which emit electromagnetic radiation in response to said voltage;

said inner surface of said back substrate having a plurality of concave and convex surface areas, on which are formed a layer of fluorescent material which emits visible light in response to excitation by said electromagnetic radiation, said visible light being transmitted through said concave portion and said front transparent substrate to said first surface.

2. The panel display according to claim 1 wherein the layer of fluorescent material is formed on a back surface of the gas discharge space, and the light emitted by the fluorescent layer is radiated towards said first surface.

3. The panel display according to claim 1 wherein the plurality of concave and convex areas is formed by arranging bulk materials on a flat plane.

4. The panel display according to claim 3 wherein said bulk materials are formed of glass beads.

5. The panel display according to claim 3 wherein the diameter of said bulk material is in the range of about 50 to 150 $\mu$m.

* * * * *